US008419568B2

(12) United States Patent
Roberts et al.

(10) Patent No.: US 8,419,568 B2
(45) Date of Patent: Apr. 16, 2013

(54) MUSCLE-BACK, WITH INSERT, IRON TYPE GOLF CLUB HEAD

(75) Inventors: Douglas E. Roberts, La Palma, CA (US); Trent E. Garner, Champaign, IL (US); Kevin A. Wolfe, Huntington Beach, CA (US); Daniel J. Stone, Long Beach, CA (US); Christopher J. Beck, Costa Mesa, CA (US); Todd D. Harman, Huntington Beach, CA (US); Brent L. Newsome, Corona, CA (US); Michael J. Wallans, Huntington Beach, CA (US); Nathaniel J. Radcliffe, Huntington Beach, CA (US)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 13/314,819

(22) Filed: Dec. 8, 2011

(65) Prior Publication Data

US 2012/0077618 A1 Mar. 29, 2012

Related U.S. Application Data

(60) Division of application No. 12/478,219, filed on Jun. 4, 2009, now Pat. No. 8,083,610, which is a continuation of application No. 11/976,819, filed on Oct. 29, 2007, now Pat. No. 7,563,176, which is a continuation of application No. 11/188,665, filed on Jul. 26, 2005, now Pat. No. 7,390, 270.

(60) Provisional application No. 60/590,907, filed on Jul. 26, 2004.

(51) Int. Cl.
*A63B 53/04* (2006.01)

(52) U.S. Cl.
USPC ..... 473/329; 473/332; 473/349; 473/350

(58) Field of Classification Search ..... 473/324–350, 473/287–292
See application file for complete search history.

(56) References Cited

U.S. PATENT DOCUMENTS

| | | | | |
|---|---|---|---|---|
| 1,139,985 | A | | 5/1915 | Legh |
| 2,846,228 | A | | 8/1958 | Reach |
| 3,079,157 | A | | 2/1963 | Turner |
| 3,810,631 | A | | 5/1974 | Braly |
| D246,328 | S | | 11/1977 | Tanner |
| D247,383 | S | | 2/1978 | Adkins |
| 4,355,808 | A | * | 10/1982 | Jernigan et al. ..... 473/324 |
| 4,621,808 | A | | 11/1986 | Orchard et al. |
| 4,754,977 | A | | 7/1988 | Sahm |
| 4,798,383 | A | | 1/1989 | Nagasaki et al. |
| 4,811,950 | A | | 3/1989 | Kobayashi |
| 4,848,747 | A | | 7/1989 | Fujimura et al. |
| 4,852,880 | A | | 8/1989 | Kobayashi |
| 4,883,274 | A | | 11/1989 | Hsien |

(Continued)

*Primary Examiner* — Sebastiano Passaniti
(74) *Attorney, Agent, or Firm* — Steptoe & Johnson LLP

(57) ABSTRACT

A muscle-back iron golf club head includes a blade-like upper mass, a muscle-like lower mass, a planar front surface, a top surface, a sole surface, a heel surface, a toe surface, and a rear surface having a first contour. A recess is in the rear surface, the recess having a first portion in the blade-like upper mass and a second portion in the muscle-like lower mass. An insert may be provided in the recess, and such insert may substantially fill the recess and may include a back surface having a second contour which is different from the first contour of the club head rear surface.

14 Claims, 22 Drawing Sheets

U.S. PATENT DOCUMENTS 4,884,812 A 12/1989 Nagasaki et al.
4,928,972 A 5/1990 Nakanishi et al.
4,955,610 A 9/1990 Creighton et al.
5,082,278 A 1/1992 Hsien
5,104,457 A 4/1992 Viljoen et al.
D336,758 S 6/1993 Jossey
5,242,167 A 9/1993 Antonious
5,290,036 A 3/1994 Fenton et al.
5,316,298 A 5/1994 Hutin et al.
5,333,872 A 8/1994 Manning et al.
5,385,348 A 1/1995 Wargo
5,409,229 A * 4/1995 Schmidt et al. ..... 473/332
5,423,546 A 6/1995 Manning et al.
5,425,535 A 6/1995 Gee
5,429,353 A 7/1995 Hoeflich
D361,813 S 8/1995 Guibaud et al.
D363,962 S 11/1995 Smith
D368,754 S 4/1996 Blough et al.
5,522,593 A 6/1996 Kobayashi et al.
5,540,436 A 7/1996 Boone
5,586,947 A 12/1996 Hutin
5,588,923 A 12/1996 Schmidt et al.
5,595,548 A 1/1997 Beck
5,637,045 A 6/1997 Igarashi
5,643,106 A 7/1997 Baird
5,643,111 A 7/1997 Igarashi
5,649,872 A 7/1997 Antonious
5,658,208 A 8/1997 Shimasaki
5,669,826 A * 9/1997 Chang et al. ..... 473/332
5,674,133 A 10/1997 Chang et al.
5,683,309 A * 11/1997 Reimers ..... 473/337
5,692,972 A 12/1997 Langslet
5,697,855 A 12/1997 Aizawa
5,707,302 A 1/1998 Leon et al.
D392,707 S 3/1998 Frazetta
D393,676 S 4/1998 Frazetta
D393,677 S 4/1998 Frazetta
5,749,794 A 5/1998 Kobayashi et al.
5,769,737 A * 6/1998 Holladay et al. ..... 473/336
5,810,682 A 9/1998 Carruthers
5,823,887 A 10/1998 Mikame et al.
5,899,821 A 5/1999 Hsu et al.
5,924,939 A 7/1999 Grace et al.
5,997,414 A 12/1999 Dalton
6,030,293 A 2/2000 Takeda
6,030,295 A 2/2000 Takeda
6,042,486 A 3/2000 Gallagher
6,045,456 A 4/2000 Best et al.
6,077,171 A 6/2000 Yoneyama
6,080,069 A 6/2000 Long
D434,462 S 11/2000 Reed et al.
6,159,109 A 12/2000 Langslet
6,186,903 B1 2/2001 Beebe et al.
6,200,228 B1 3/2001 Takeda
6,200,229 B1 3/2001 Grace et al.
6,206,790 B1 3/2001 Kubica et al.
6,210,290 B1 4/2001 Erickson et al.
6,273,831 B1 8/2001 Dewanjee
6,290,607 B1 9/2001 Gilbert et al.
6,290,608 B2 9/2001 Gates
6,379,263 B2 4/2002 Erickson et al.
D458,328 S 6/2002 Solheim et al.
6,409,612 B1 6/2002 Evans et al.
6,482,104 B1 11/2002 Gilbert
D466,960 S 12/2002 Imamoto
D470,554 S 2/2003 Truesdale
D473,605 S 4/2003 Petersen et al.
6,554,722 B2 4/2003 Erickson et al.
6,592,468 B2 7/2003 Vincent et al.
6,592,469 B2 7/2003 Gilbert
D479,568 S 9/2003 Rodgers et al.
6,683,152 B2 1/2004 Wu et al.
6,688,989 B2 2/2004 Best
6,695,714 B1 2/2004 Bliss et al.
6,709,345 B2 3/2004 Iwata
6,719,641 B2 4/2004 Dabbs et al.
6,835,144 B2 * 12/2004 Best ..... 473/332
6,855,066 B2 2/2005 Best
6,902,495 B2 6/2005 Pergande et al.
6,921,344 B2 7/2005 Gilbert et al.
6,962,538 B2 11/2005 Roach et al.
7,244,188 B2 * 7/2007 Best ..... 473/291
7,390,270 B2 6/2008 Roberts et al.
7,563,176 B2 7/2009 Roberts et al.
7,803,068 B2 * 9/2010 Clausen et al. ..... 473/350
8,083,610 B2 * 12/2011 Roberts et al. ..... 473/329
2001/0007834 A1 7/2001 Gates
2001/0029208 A1 10/2001 Takeda
2002/0004429 A1 1/2002 Wu et al.
2002/0098910 A1 7/2002 Gilbert
2002/0128088 A1 9/2002 Yializis et al.
2003/0022729 A1 1/2003 Pergande et al.
2003/0119602 A1 6/2003 Kennedy, III et al.
2003/0139225 A1 7/2003 Rife
2003/0203764 A1 10/2003 Dabbs et al.
2003/0236134 A1 12/2003 Nishitani
2004/0058745 A1 3/2004 Clausen
2004/0214657 A1 10/2004 Hou
2005/0239572 A1 10/2005 Roach et al.
2005/0277485 A1 12/2005 Hou et al.
2006/0172822 A1 * 8/2006 Liang et al. ..... 473/350
2008/0020861 A1 * 1/2008 Adams et al. ..... 473/334
2009/0105007 A1 * 4/2009 Lin et al. ..... 473/332

* cited by examiner

MUSCLE-BACK, WITH INSERT, IRON TYPE GOLF CLUB HEAD

The present application is a divisional of application Ser. No. 12/478,219, filed Jun. 4, 2009, now U.S. Pat. No. 8,083,610 which is a continuation of application Ser. No. 11/976,819, filed Oct. 29, 2007, now U.S. Pat. No. 7,563,176, which is a continuation of application Ser. No. 11/188,665, filed Jul. 26, 2005, now U.S. Pat. No. 7,390,270 issued Jun. 24, 2008, and claims priority to U.S. provisional application Ser. No. 60/590,907, filed Jul. 26, 2004, which application is incorporated herein by reference in its entirety.

FIELD OF THE INVENTION

The present invention relates to the design of iron type golf club heads, and more particularly, to muscle-back iron type club heads.

BACKGROUND OF THE INVENTION

Cavity-back iron type club heads, also known as perimeter weighted irons, are known to have a concentration of mass about the periphery of a rear surface of the club head. This concentration of mass is in a raised, rib-like, perimeter weighting element that substantially surrounds a rear cavity, which comprises a major portion of the rear surface of the club head. In addition to locating a substantial amount of mass away from the center of the club head behind the club face, the rib-like perimeter weighting element acts as a structural stiffener, which compensates for reduction in face thickness in the cavity region.

Cavity-back clubs are quite forgiving when a ball is struck away from the optimal impact point, or sweet spot, of the club face, in part due to increased moment of inertia provided by the perimeter weighting element. On such off-center hits, distance lost due to head rotation, resulting from the ball striking force being applied distal from the sweet spot, is minimized. Further, harsh vibrations transmitted through the shaft to the hands of the golfer are also minimized.

Therefore, cavity-back clubs permit a golfer to strike the ball anywhere within a significant area on the clubface without realizing significant negative physical effects or performance losses. For this reason cavity-back clubs are well suited to inexperienced or less skilled golfers, who struggle to consistently and accurately strike a golf ball at the sweet spot of the club head. Skilled golfers, who consistently strike a golf ball at the sweet spot of their club heads have found that cavity-back clubs generally provide less feel because they are designed for maximum forgiveness. To these golfers, cavity-back clubs may not provide the feedback or ball control required for shaping their shots (commonly referred to as "working" the ball) to accommodate a variety of playing conditions.

Muscle-back or blade irons are characterized by a thick lower portion known as the "muscle", which extends along the entire length of the head. A thin upper portion extends upwardly from the muscle and behind the face of the club, and is commonly referred to as the blade portion. The blade portion has no reinforcement ribs or perimeter weighting, the only concentration of mass being in the muscle of the club, behind its sweet spot. Typically, a muscle-back club head is smaller than a cavity-back head, due to the solid muscle portion having substantial mass. This configuration provides excellent feel when a ball is struck at the sweet spot, but typically yields a harsher sensation as well as greater distance loss associated with off-center shots in comparison to similar shots hit with cavity-back irons. For these reasons, muscle-back clubs are generally better suited to skilled golfers who consistently strike the ball within close proximity of the sweet spot. Muscle-back clubs therefore are more difficult to hit, but provide skilled golfers with desired control and shot shaping ability, or workability.

The benefits of cavity-back irons are best realized in the lower numbered irons, or long irons, which are known to be the most challenging to hit effectively for many golfers of all skill levels. By comparison, higher numbered short irons, even those of the muscle-back type, are generally perceived as being substantially easier to hit effectively. For this reason, golfers of all skill levels generally forfeit the forgiveness benefits of cavity-back clubs when they select the shorter irons in a set, for example wedges with typical lofts from about 44 to about 66 degrees, in exchange for the workability and feel of muscle-back clubs.

Although it is generally easier effectively to strike a short, muscle-back iron than a long, muscle-back iron, a need nonetheless exists for improvements in the feel and forgiveness of muscle-back irons.

SUMMARY OF THE INVENTION

The present invention comprises a muscle-back iron golf club head having improved feel and forgiveness characteristics. In one embodiment of the invention, the club head includes a planar front surface, a top surface, a sole surface, a heel surface, a toe surface, and a rear surface having a first contour. The club head has a blade-like upper mass and a muscle-like lower mass defined by the rear surface, planar front surface, top surface, sole surface, heel surface, and toe surface. A recess is provided in the rear surface, the recess having a first portion and a second portion, where the first portion is formed in the blade-like upper mass and the second portion is formed in the muscle-like lower mass.

An insert may be provided in the recess. The insert may substantially fill the recess and may include a back surface having a second contour which does not follow the first contour of the club head rear surface.

BRIEF DESCRIPTION OF THE DRAWINGS

The invention is further explained in conjunction with the following figures illustrating the present invention.

FIG. 14(*b*) is a rear view of the insert of FIG. 14(*a*);

FIG. 14(*c*) is a perspective view of a first piece of the insert of FIG. 14(*a*);

FIG. 14(*d*) is a perspective view of a second piece of the insert of FIG. 14(*a*);

FIG. 15(*b*) is a rear view of the insert of FIG. 15(*a*);

FIG. 15(*c*) is a perspective view with a perspective sectional view of a first piece of the insert of FIG. 15(*a*);

FIG. 15(*d*) is a perspective view with a perspective sectional view of a second piece of the insert of FIG. 15(*a*);

FIG. 16(*b*) is a sectional view of the insert of FIG. 16(*a*), depicting one two piece configuration of the insert;

FIG. 16(*c*) is a section view of a first piece of the insert of FIG. 16(*b*);

FIG. 16(*d*) is a section view of a second piece of the insert of FIG. 16(*b*);

FIG. 16(*e*) is a sectional view of the insert of FIG. 16(*a*), depicting another two piece configuration;

FIG. 16(*f*) is a sectional view of a first piece of the insert of FIG. 16(*e*);

FIG. 16(*g*) is a sectional view of a second piece of the insert of FIG. 16(*e*);

FIG. 16(*h*) is a sectional view of the insert of FIG. 16(*a*), depicting one, three-piece insert configuration;

FIG. 16(*i*) is an exploded sectional view of the insert of FIG. 16(*h*);

FIG. 16(*j*) is a sectional view of the insert of FIG. 16(*a*), depicting another possible three-piece configuration;

FIG. 16(*k*) is an exploded sectional view of the insert of FIG. 16(*j*);

FIG. 17(*b*) is a side view of a portion of the insert of FIG. 17(*b*);

FIG. 17(*c*) is an exploded perspective view of yet another two-piece insert configuration;

For purposes of illustration the figures herein are not necessarily drawn to scale. In all of the figures, like components are designated by like reference numerals.

DETAILED DESCRIPTION

Throughout the following description, specific details are stated to provide a more thorough understanding of the invention. However, the invention may be practiced without these particulars. In other instances, well known elements have not been expressly shown or described. Accordingly the detailed description and drawings are to be regarded in an illustrative rather than a restrictive sense.

Figure 1:
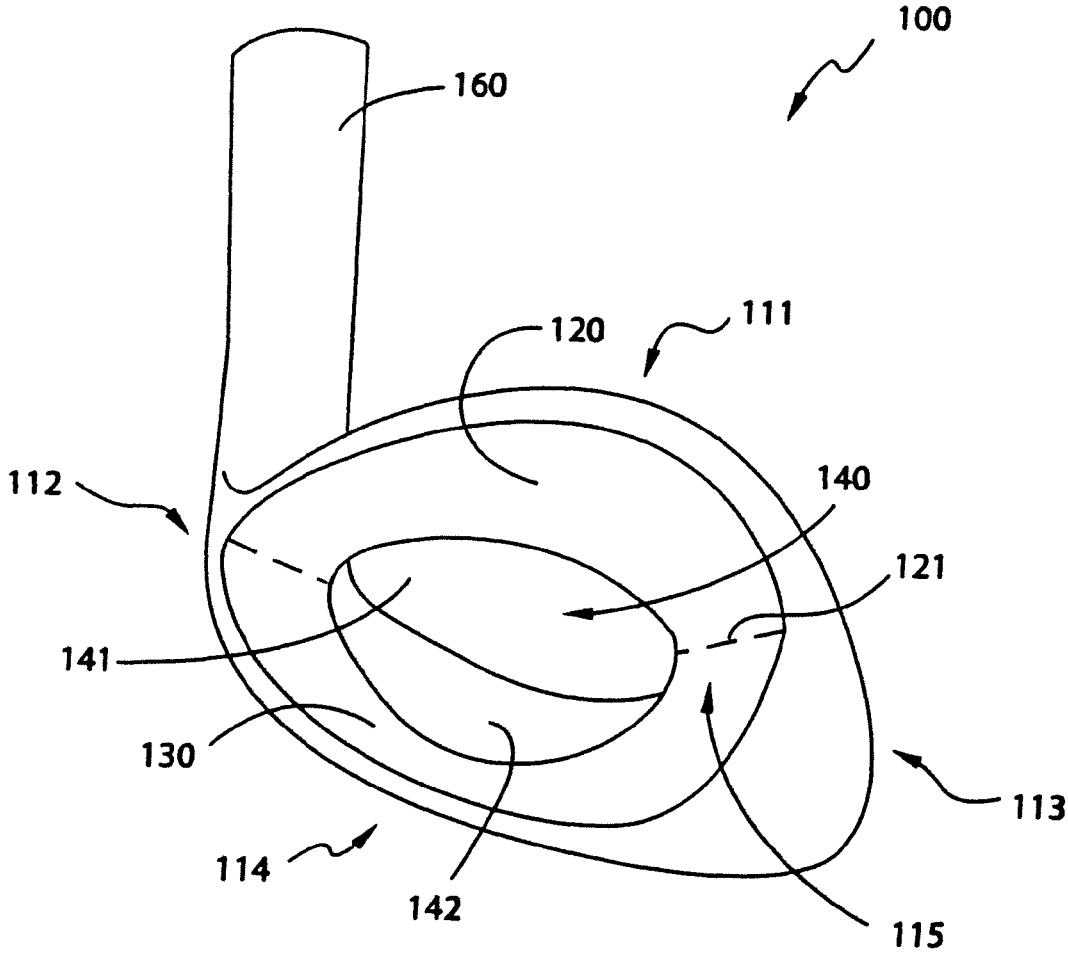
FIG. 1 is a rear perspective view of an embodiment of a club head in accordance with the present invention.
Figure 2:
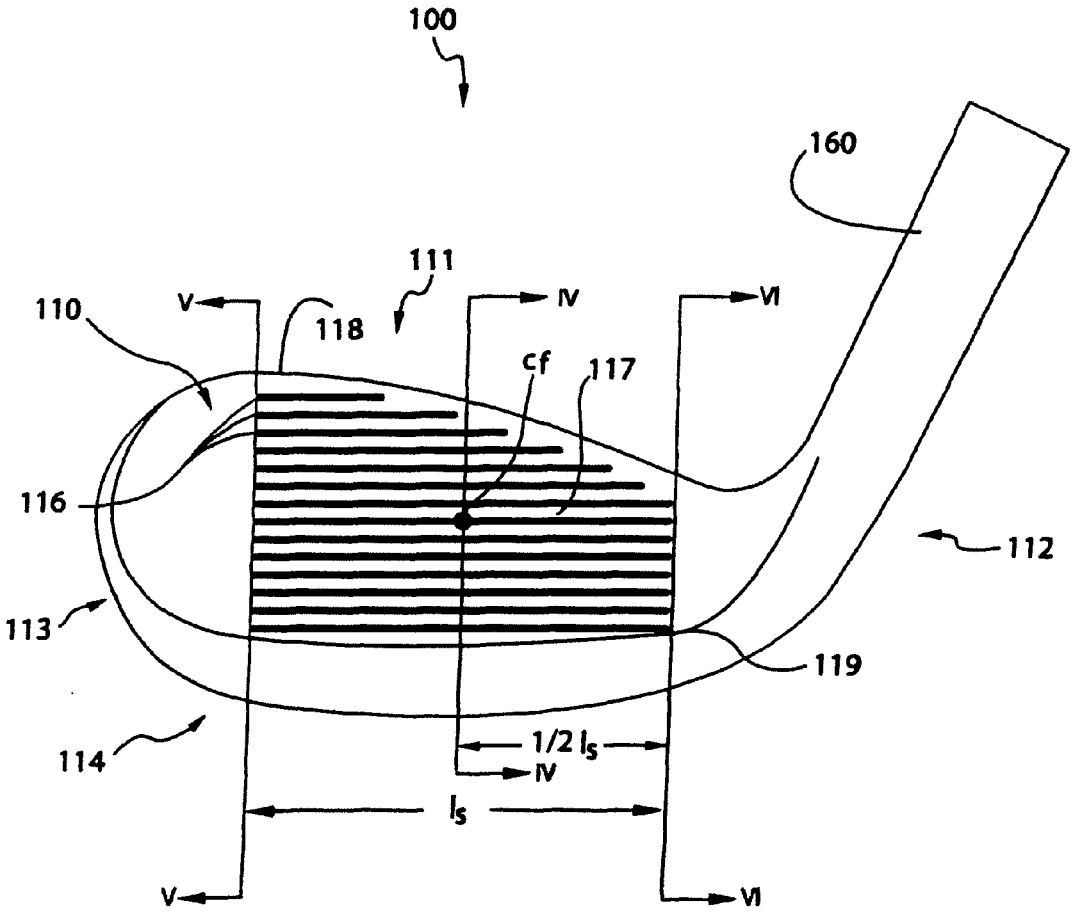
FIG. 2 is a front or face view of the club head of FIG. 1.

Referring to FIGS. 1 and 2, a golf club head 100, for example, a wedge head, is shown having a traditional muscle-back iron configuration with a recess 140 formed on a rear surface 115. The muscle-back shape is generally defined by a top surface 111, a heel surface 112, a toe surface 113 and a sole surface 114 each contiguous to a front surface 110 and rear surface 115. Front surface 110 forms an angle relative to the ground when held in an address position, and this angle is known as the loft, or loft angle, of the club head. A hosel 160 is located at the heel surface 112. The rear surface comprises a substantially flat area, which defines a blade portion 120 of the club head, and a contoured area which defines a muscle portion 130 of the club head. The blade portion generally occupies the entire upper portion of the club head, and has a substantially constant thickness that may be less than, for example, about 0.25 inches. The muscle portion generally constitutes a lower portion of the club head, and has a varying thickness that is everywhere greater than that of blade portion 120. Recess 140 is formed in at least the muscle portion, and preferably also extends into the blade portion, as shown in FIG. 1.

The muscle portion may be generally separated from the blade portion transition line 121, represented by a phantom line. If there is no distinct boundary separating the muscle and blade portions, such as in the case of the embodiment shown in the figures, the transition between the muscle and blade portions may occur via a gradual surface curvature, for example at the perigee defined by blade portion 120 and muscle portion 130.

Referring to FIG. 2, a portion of front surface 110 is provided with a plurality of scorelines 116 therein to define a ball striking area 117. The ball striking area is generally defined by the heel and toe extremities of the scorelines, indicated in FIG. 2 by section lines VI-VI and V-V, respectively, and segments of the top and bottom edges 118 and 119 of the front surface bounded by those extremities. Thus, the scorelines between section lines VI-VI and V-V are substantially equal in length and define a ball striking area length $l_s$. The ball striking area has a height that varies due to the curvature of top edge 118, which generally causes the height to increase in the toe direction. The height may be a minimum at the heelmost extent of ball striking area 117, and a maximum at some point in the toe direction. The ball striking area has a center $c_f$ defined at a position that is laterally half of scoreline length $l_s$, and half the ball striking area height at that lateral position, $h_f$ (See FIG. 4).

Figure 3:
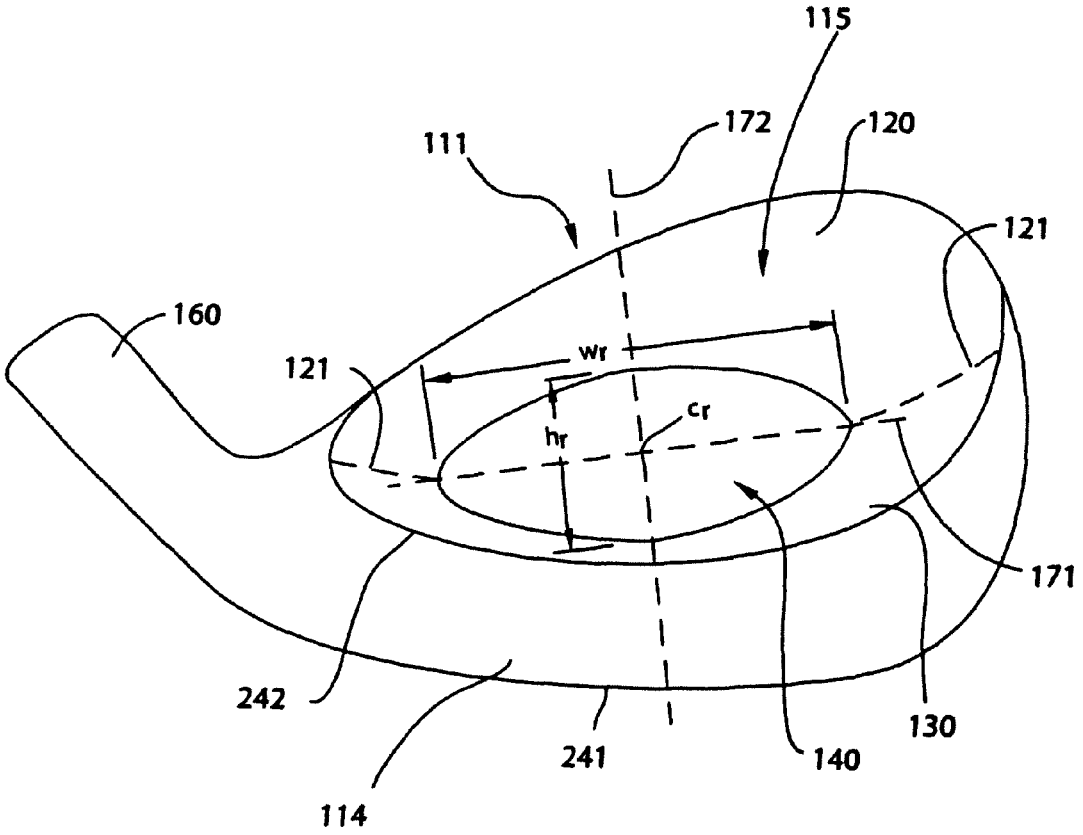
FIG. 3 is a rear or back view of the club head of FIG. 1, with the planar front surface about parallel to the plane of the page.
Figure 4:
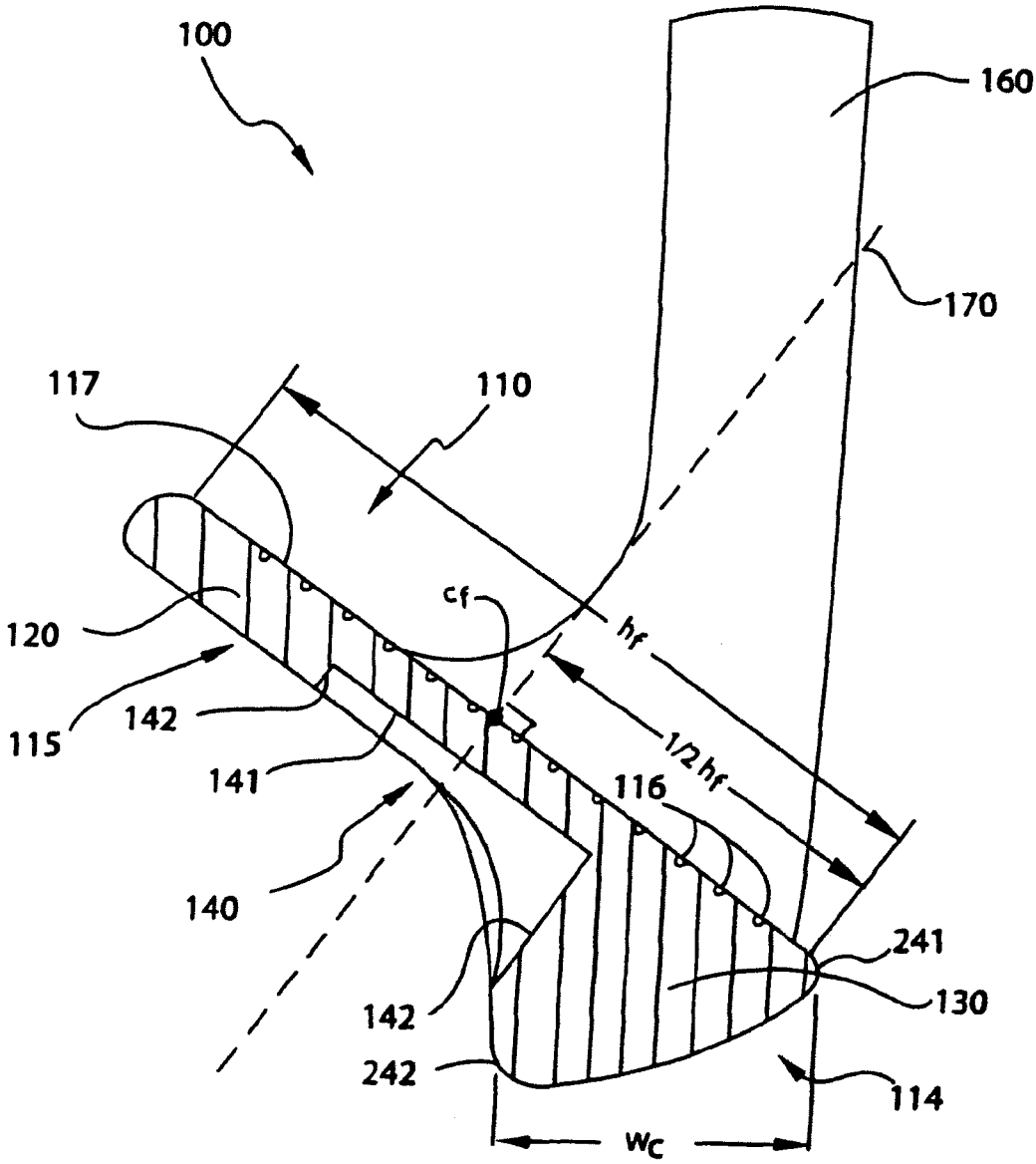
FIG. 4 is a first, vertical cross-sectional view from the toe end of the club head of FIG. 1.

Referring now to FIGS. 3 and 4, the recess formed in the rear surface of club head 100 has a width $w_r$, a height $h_r$, a bottom wall 141, at least one perimeter wall 142 (depending on the shape of the recess), and a geometric center $c_r$. The width of the recess at its maximum is generally less than the ball striking area length $l_s$, and the height of the recess at its maximum is generally less than half of height $h_f$. The geometric center refers to the centroid of the area defined by the planar shape of the recess. The planar shape of recess 140 is determined by intersecting perimeter wall 142 with a plane substantially parallel to front surface 110 whereby such intersection is a continuous line defining a closed loop. The recess is positioned on the rear surface of the club head such that its geometric center $c_r$ is located proximate an axis 170 passing through ball striking area center $c_r$ and perpendicular to the front surface. In an alternate embodiment, the recess is positioned on the rear surface of the club head such that its geometric center $c_r$ is co-linear with axis 170.

The geometric shapes defined by perimeter wall 142 and the perimeter of rear surface 115 are dissimilar. Otherwise, the recess can define any generally planar shape, e.g. square, ellipsoidal, circular, or any other desired geometric shape. Preferably, the shape of recess 140 is nearly symmetrical along any number of axes, preferably at least one. In one embodiment of the invention, recess 140 has a geometric shape that is nearly symmetrical about two axes, a first axis 171 and a second axis 172 (see FIG. 3). Axes 171 and 172 may, but need not be, mutually perpendicular. This recess configuration provides favorable weighting characteristics and is aesthetically pleasing. While one skilled in the art of club making will recognize that certain orientations may be more desirable than others, recess 140 may be formed in a variety of orientations to provide the aforementioned advantages of the invention.

Figure 5:
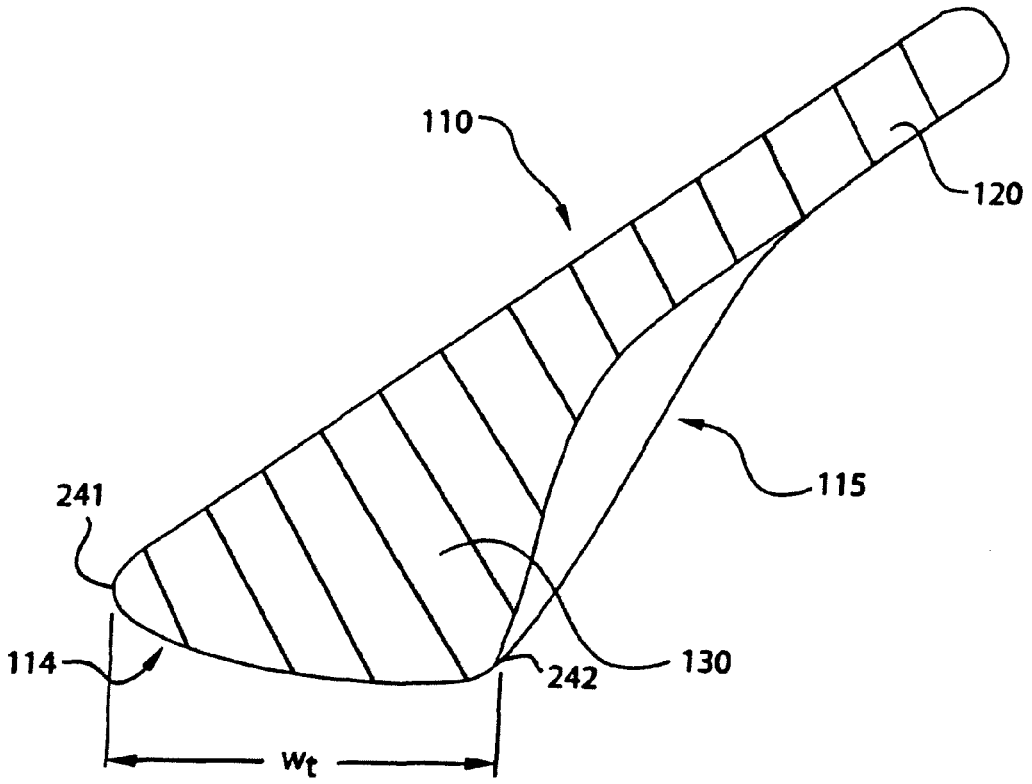
FIG. 5 is a second, vertical cross-sectional view from the heel end of the club head of FIG. 1.
Figure 6:
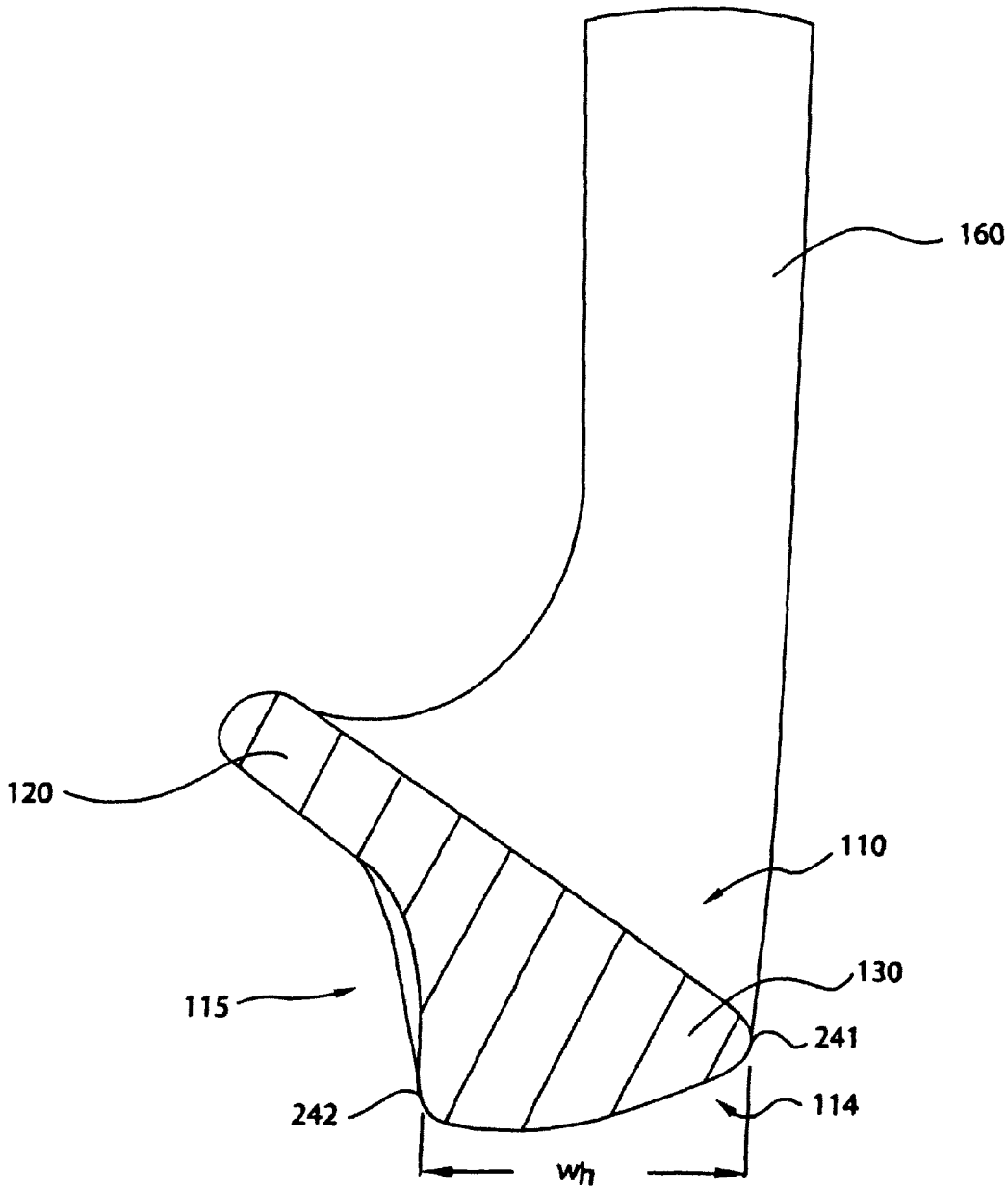
FIG. 6 is a third, vertical cross-sectional view more proximate the heel end of the club head of FIG. 1.
Figure 7:
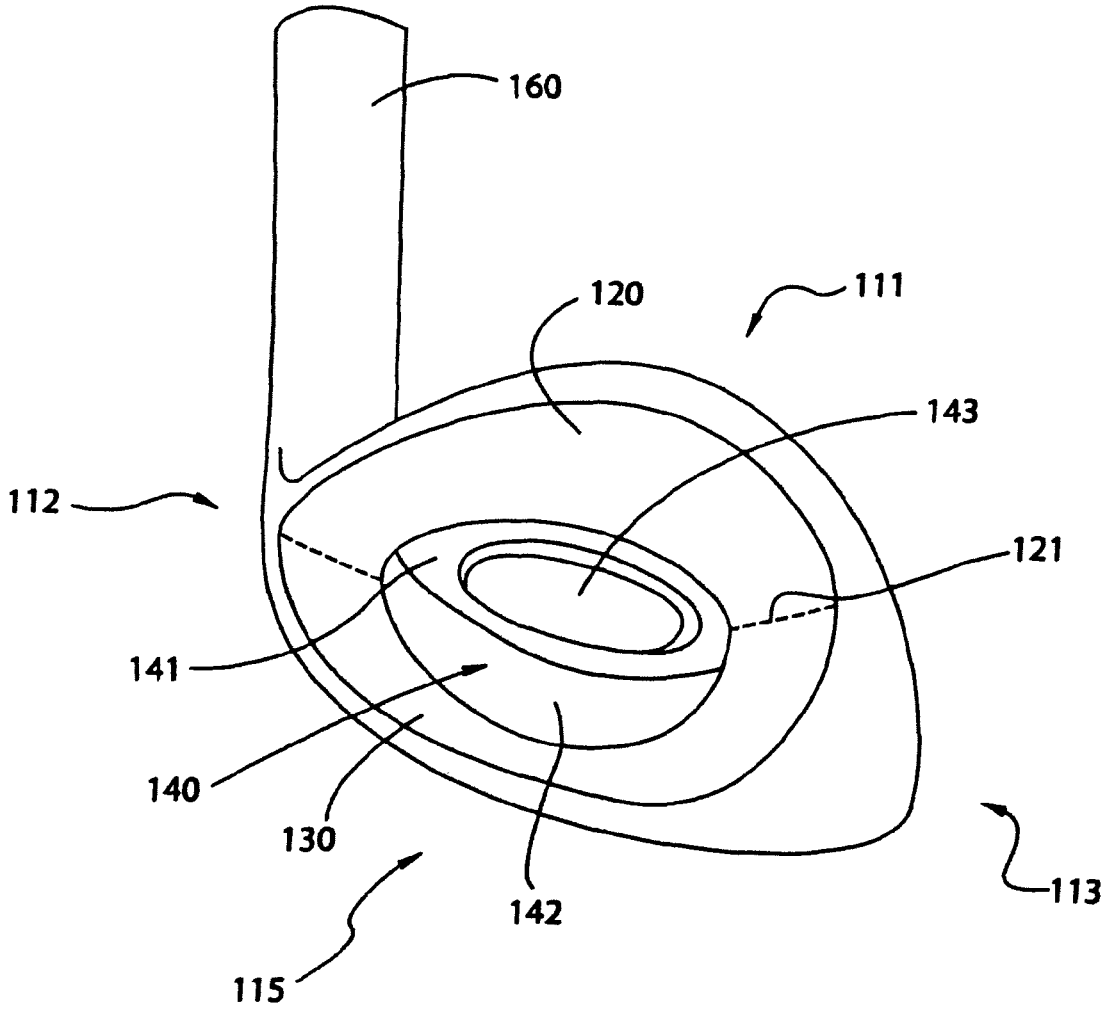
FIG. 7 is a rear perspective view of another embodiment of a club head in accordance with the present invention, depicting a step located in the recess.
Figure 8:
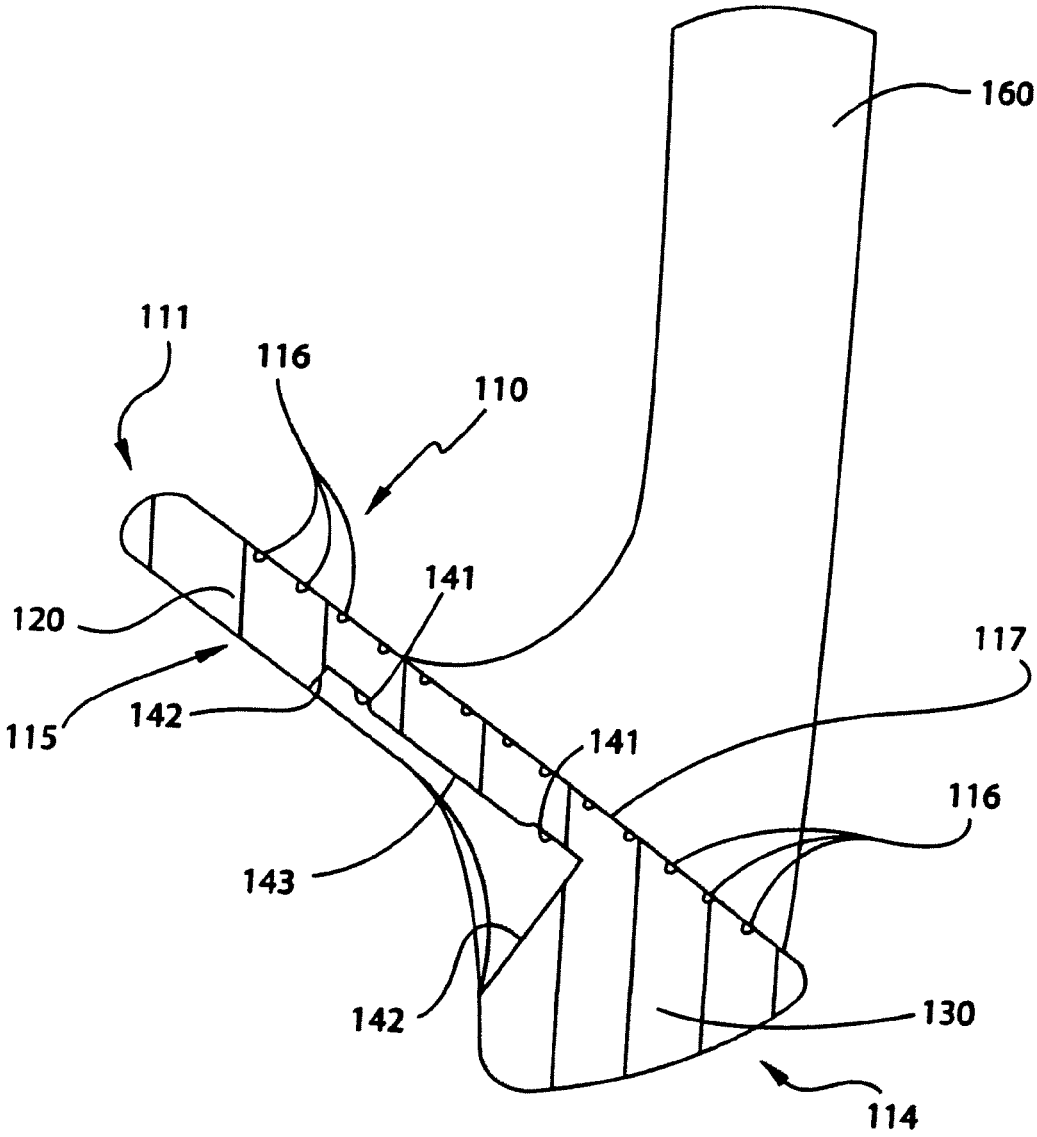
FIG. 8 is a vertical cross-sectional view from the toe end of the club head of FIG. 7.
Figure 9:
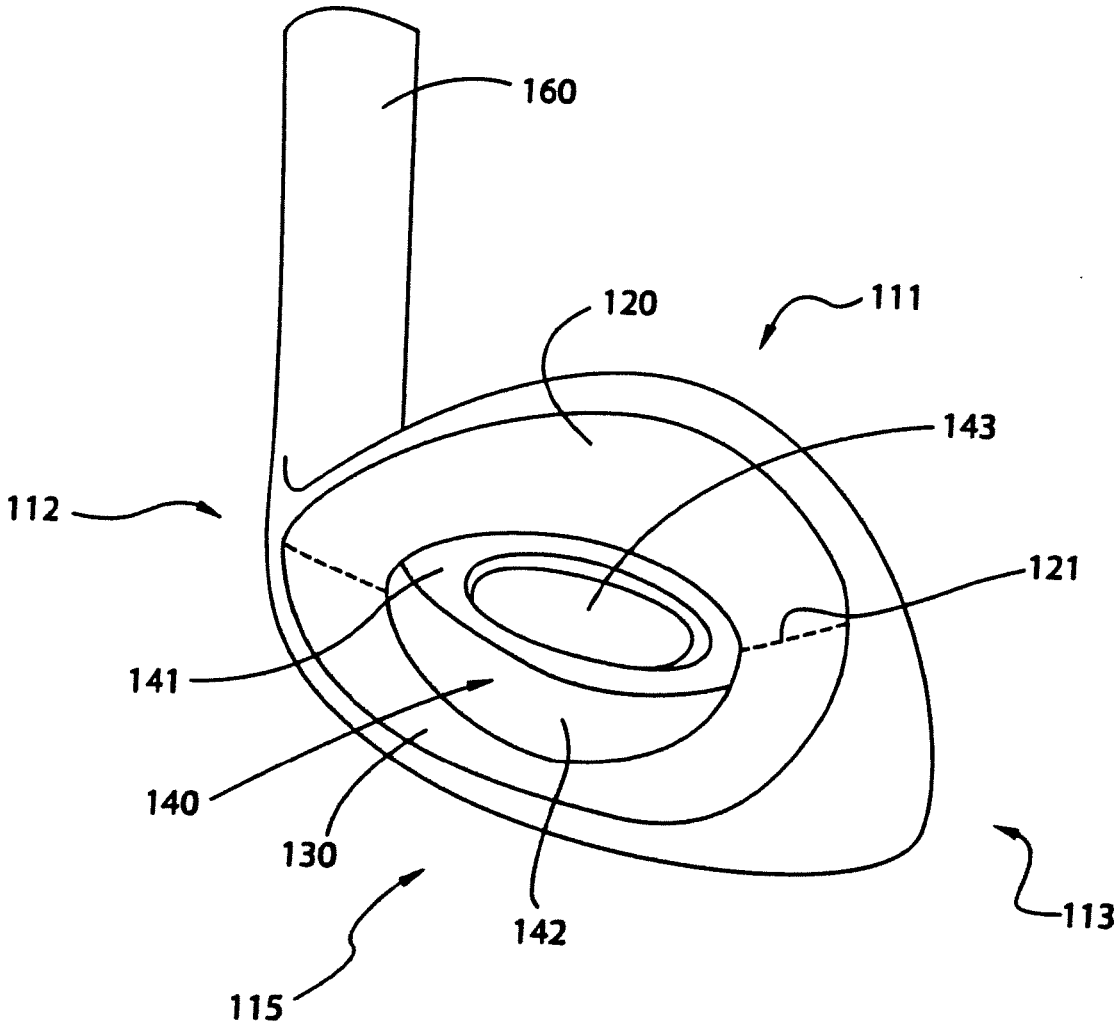
FIG. 9 is a rear perspective view of yet another embodiment of a club head in accordance with the present invention, depicting a step located in the recess.
Figure 10:
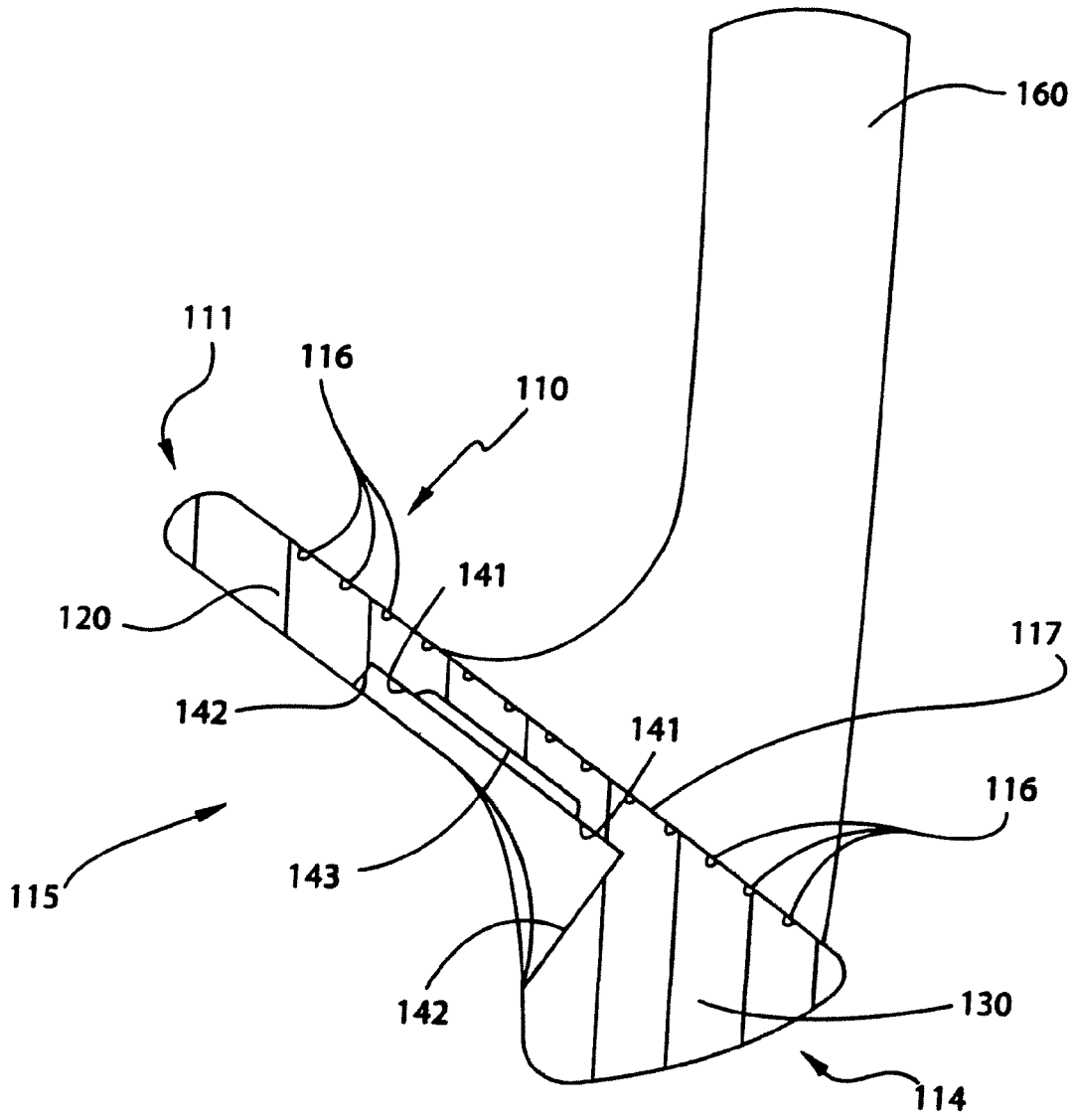
FIG. 10 is a vertical cross-sectional view from the toe end of the club head of FIG. 9.

Recess 140 preferably penetrates into the blade portion 120 a distance less than about half the thickness of blade portion 120. As such, the majority of the material removed in forming the recess is taken from muscle portion 130. The total mass of the material removed is redistributed to the toe and heel areas of the muscle portion to increase forgiveness on off-center shots. Redistributing the mass may be accomplished in a number of ways, for example by increasing the volume of the heel and toe regions of the muscle, resulting in sole width dimensions greater than those found in traditional muscle-back irons and wedges. Referring to FIGS. 4-6, this method creates a sole 114 that has heel and toe sole widths $w_h$ and $w_t$, respectively, that are greater than those of traditional muscle-back irons and wedges. Although, in one embodiment of the invention, the ratios of sole center width $w_c$ to the heel and toe sole widths may be less than those of a traditional muscle-back iron or wedge.

As shown in FIGS. 4-6, sole widths $w_h$, $w_t$, and $w_c$ are measured as the horizontal distance between the sole leading edge 241 and the sole trailing edge 242, with the club head 100 at an address position. Edges 241 and 242 can be determined by an observer holding the club head such that front surface 110 is parallel to the observer's line of sight with the sole surface oriented towards the observer. The lines defining the leading and trailing extremities of the sole surface in this perspective will be edges 241 and 242. In an embodiment where the ratios of sole center width $w_c$ to heel and toe sole widths $w_h$ and $w_t$ are substantially less than those of traditional club heads, as discussed above, jacking of leading edge 241 is minimized when the club head is opened at address to adjust for lie conditions or intended shot placement.

To illustrate the impact of the above described mass distribution method on club head geometry, a comparison of sole widths $w_h$, $w_t$, and $w_o$ for a known line of wedges and an exemplary set of wedges in accordance with one embodiment of the present invention is presented in the tables below. These known wedges have traditionally shaped muscle-back heads, and are known to have muscle portion volumes that are already approximately 30 percent greater than normal. Therefore, the widths measured from their soles are representative of the maximums in known traditional wedges.

TABLE 1

| Traditional sole widths | | | |
|---|---|---|---|
| Loft (deg.) | $w_h$ (in) | $w_t$ (in) | $w_c$ (in) |
| 46 | .64 | .82 | .82 |
| 52 | .69 | .84 | .82 |
| 56 | .70 | .90 | .87 |
| 60 | .74 | .96 | .89 |

TABLE 2

| Exemplary sole widths according to one embodiment of the present invention (in) | | | |
|---|---|---|---|
| Loft (deg.) | $w_h$ (in) | $w_t$ (in) | $w_c$ (in) |
| 46 | .75 | .88 | .77 |
| 52 | .78 | .91 | .800 |
| 56 | .86 | .97 | .86 |
| 60 | .89 | 1.00 | .89 |

Figure 18:
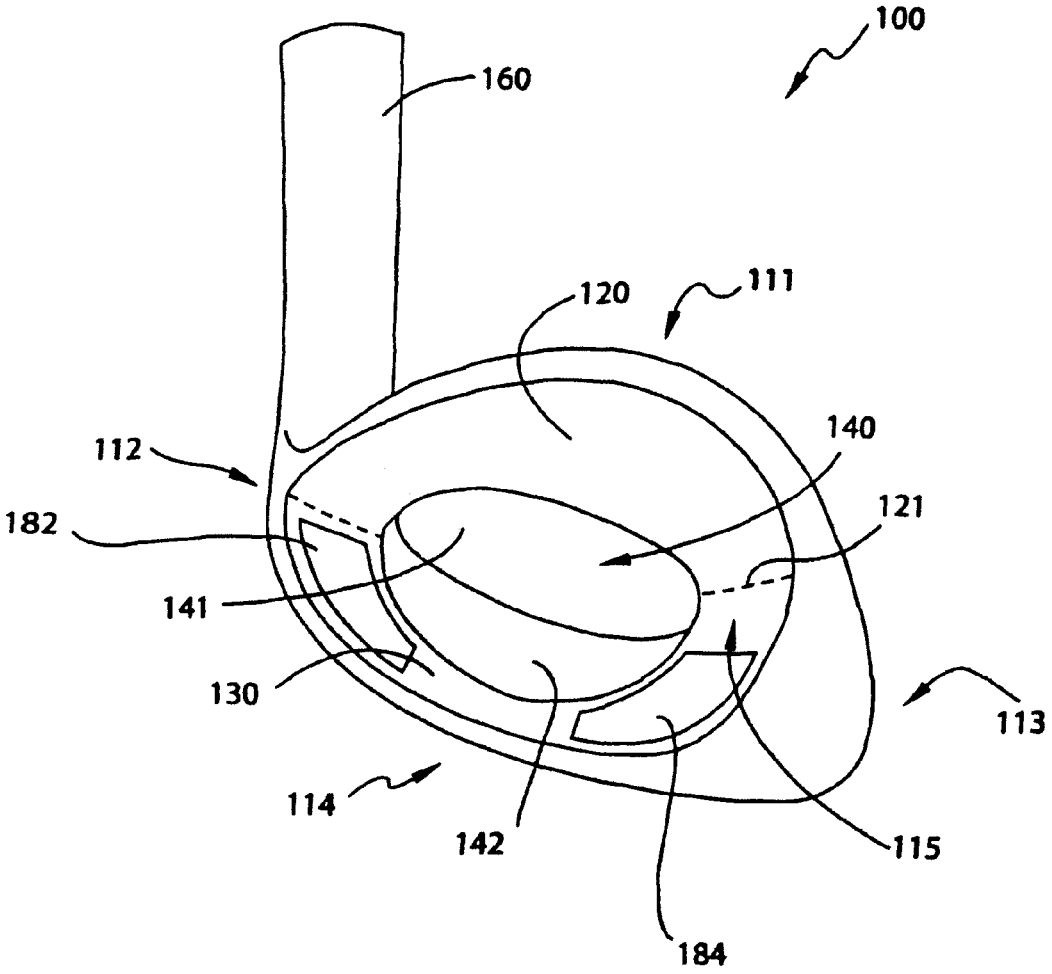
FIG. 18 is a rear perspective view of another embodiment of the invention.

In an alternate embodiment of the invention shown in FIG. 18, mass may be added to the heel and toe of the club head in the form of weighted inserts 182 and 184 added in the heel and toe regions of the muscle portion. This configuration enables maintaining traditional sole widths $w_h$, $w_t$, and $w_c$ while still providing increased forgiveness on off-center shots. Such weighted inserts may be made from any material which has a density greater than the material used to form the body of the head, for example densified polymers, tungsten, tungsten alloys, copper, copper alloys, or any other suitable materials.

In providing the aforementioned configurations, club head 100 has increased forgiveness on off-center hits, as well as superior feel at impact on such off-center hits. In addition, the advantages of traditional muscle-back irons and wedges previously discussed have not been lost. Club head 100 may be made from any material previously used for iron-type golf club heads. However, preferred materials include the ductile or gray irons disclosed in U.S. patent application Ser. No. 10/787,899, filed on Feb. 27, 2004, which is incorporated herein by reference in its entirety.

Figure 11:
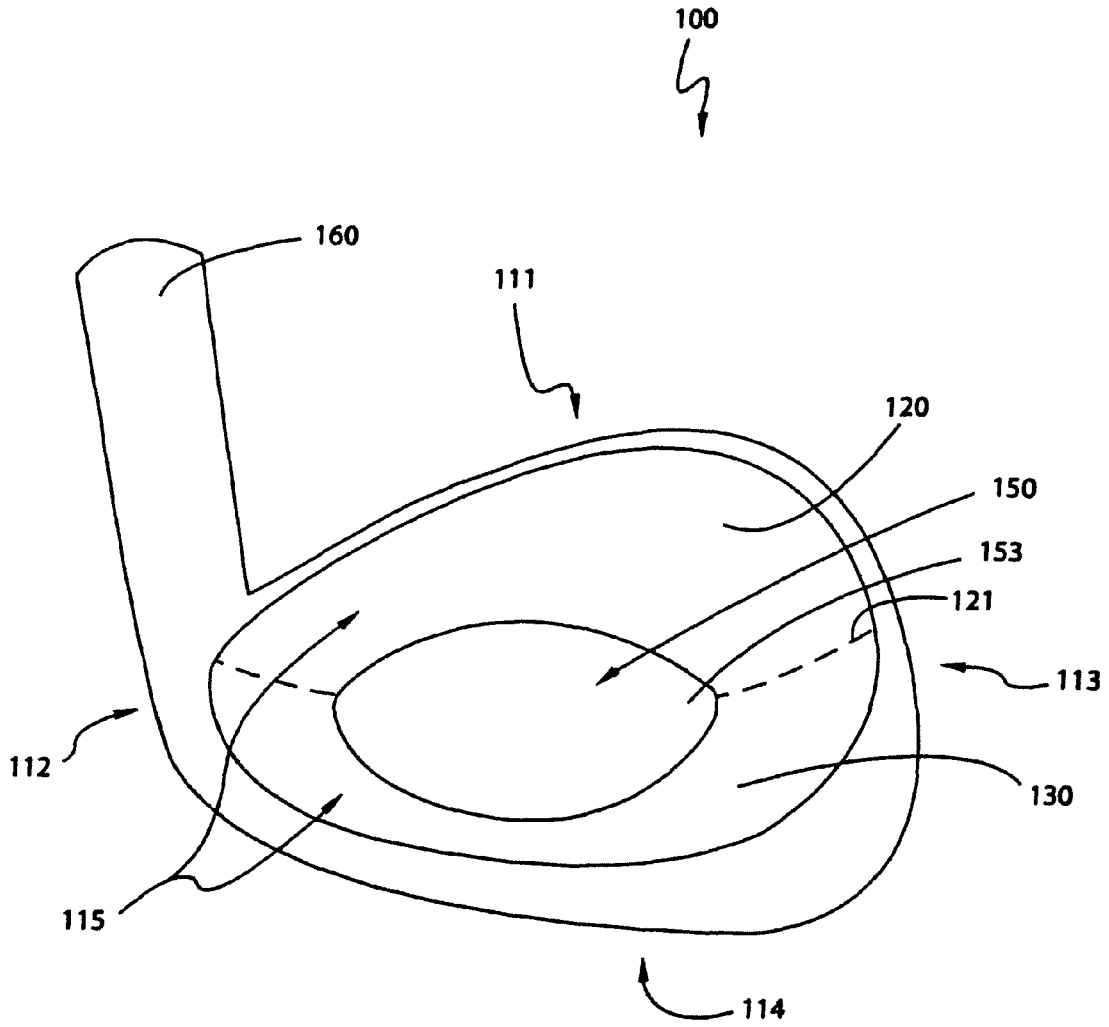
FIG. 11 is a rear view of still another embodiment of a club head in accordance with the present invention, depicting an insert substantially filling the recess.
Figure 12:
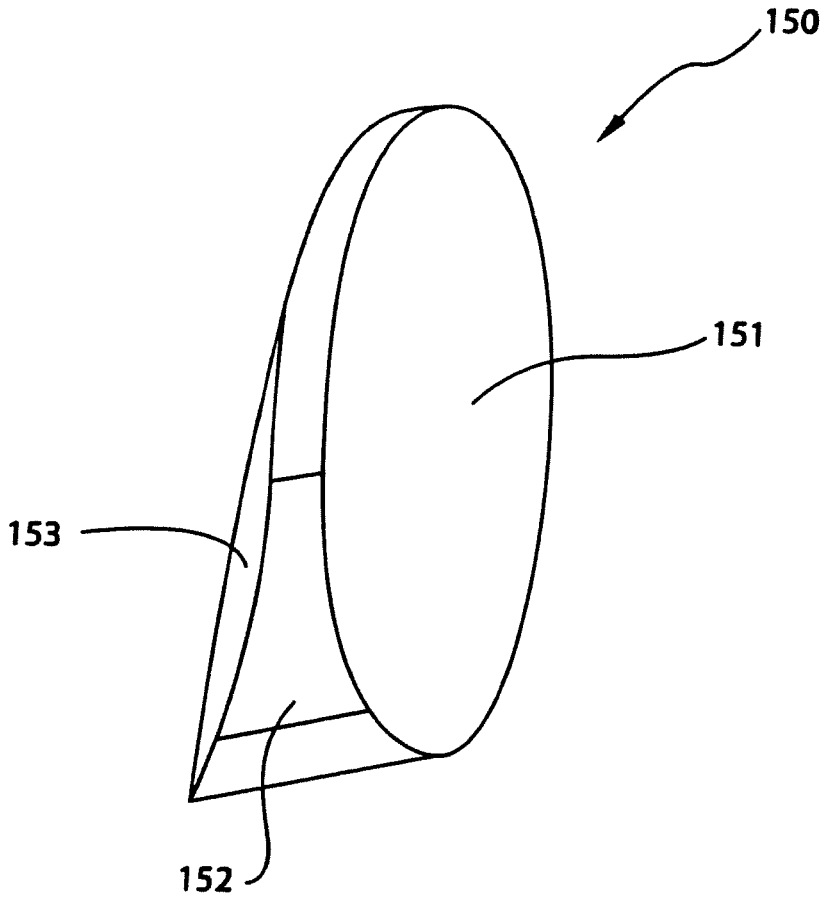
FIG. 12 is a perspective view of the insert of FIG. 11.
Figure 13:
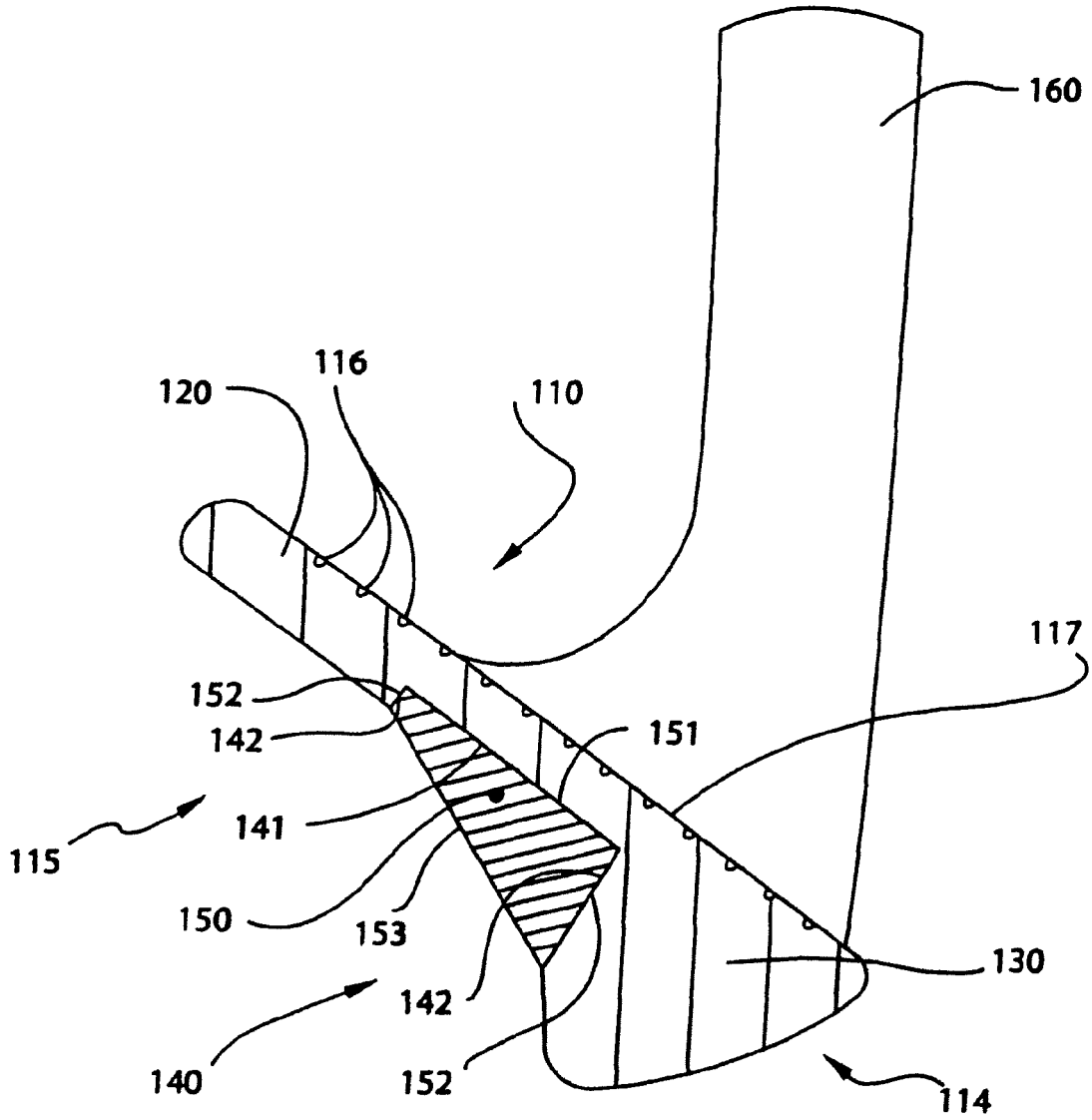
FIG. 13 is a vertical cross-sectional view from the toe end of the club head of FIG. 10.
Figure 14A:
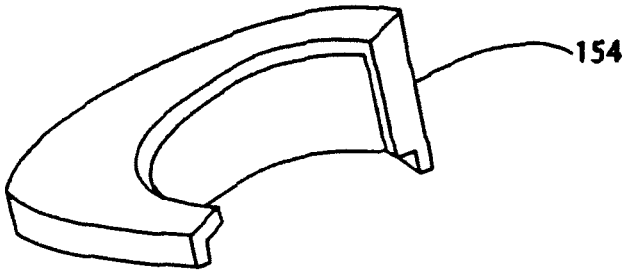
FIG. 14(*a*) is a perspective sectional view of another insert for use with a club head in accordance with another embodiment of the present invention, depicting a first two piece insert configuration.
Figure 14B:
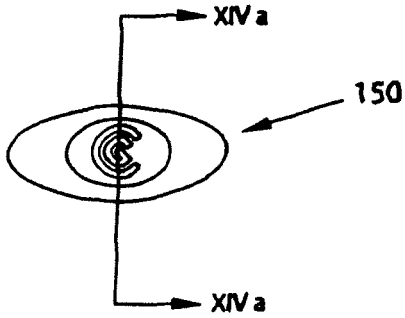
Figure 14C:
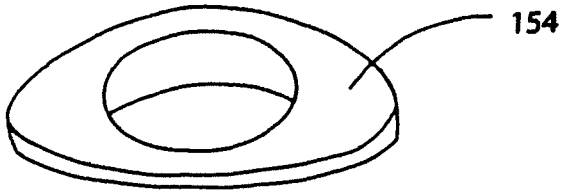
Figure 14D:
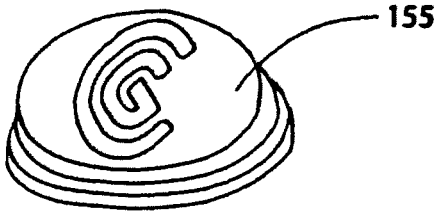
Figure 15A:
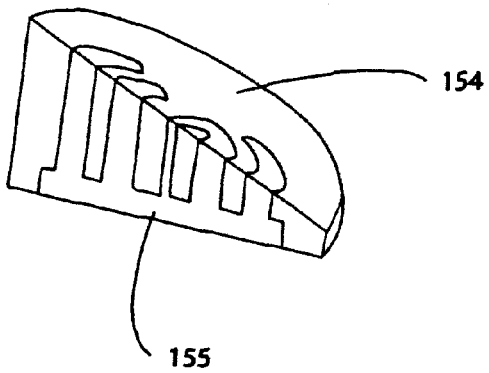
FIG. 15(*a*) is a perspective sectional view of an insert for use with a club head in accordance with yet another embodiment of the present invention, depicting a second two piece insert configuration.
Figure 15B:
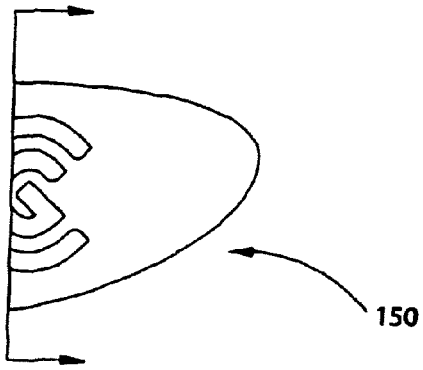
Figure 15C:
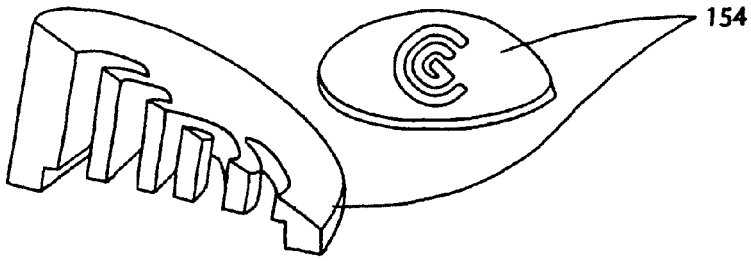
Figure 15D:
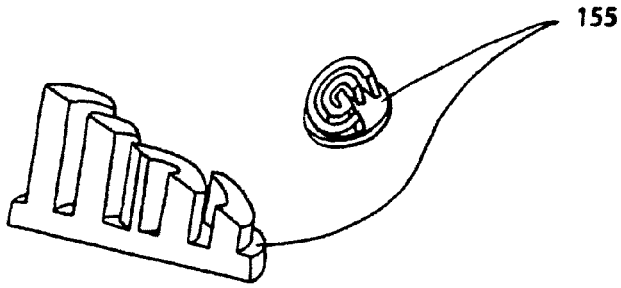
Figure 16C:
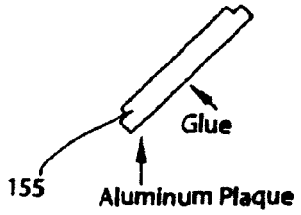
FIG. 16(*a*) is a perspective view of an insert for use with a club head in accordance with another embodiment of the present invention.
Figure 16D:
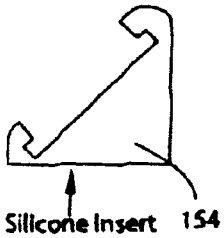
Figure 16B:
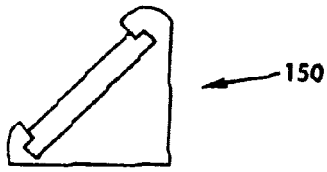
Figure 16I:
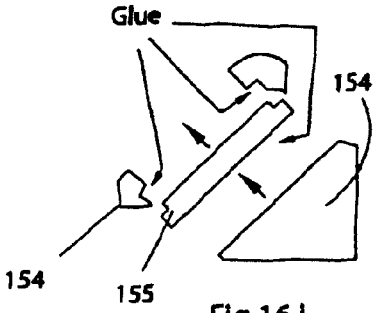
Figure 16H:
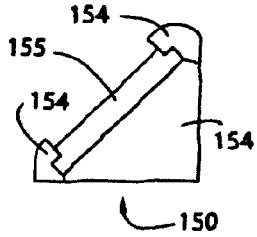
Figure 16A:
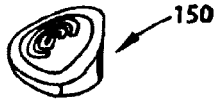
Figure 16K:
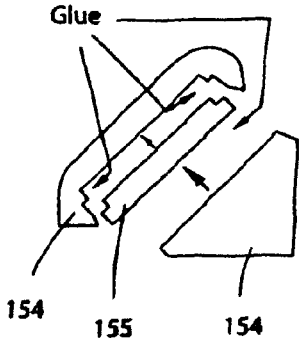
Figure 16J:
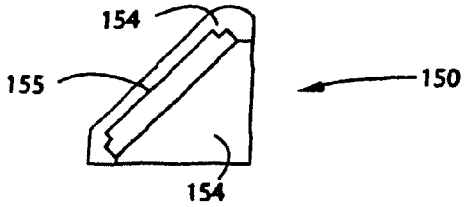
Figure 16F:
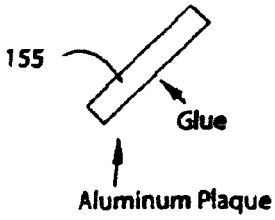
Figure 16G:
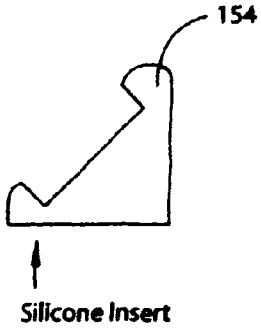
Figure 16E:
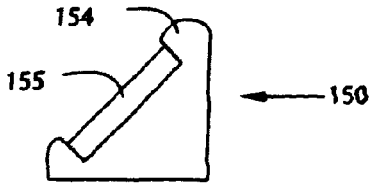
Figure 17A:
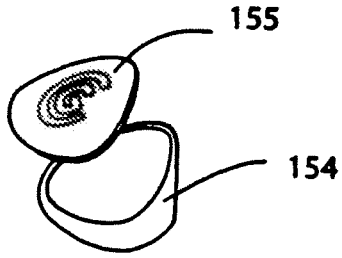
FIG. 17(*a*) is an exploded perspective view of a two-piece insert configuration.
Figure 17B:
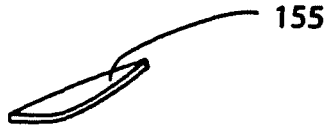
Figure 17C:
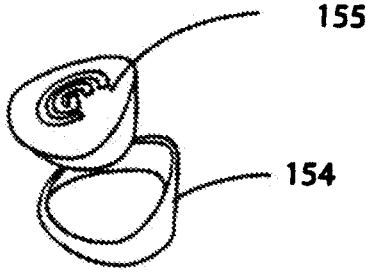

Referring now to an alternate embodiment of the invention shown in FIGS. 11-13, recess 140 may be substantially filled with an insert 150 made from a material having a significantly lower specific gravity than the material used for club head 100. The insert comprises a forward surface 151, at least one perimeter wall 152 and a back surface 153. A preferred material for insert 150 is one having a specific gravity in a range from about 0.90 to about 3.0. Exemplary materials include polymers, fiber reinforced plastics, and low density metals such as magnesium or aluminum.

In addition to serving as lightweight filler for recess 140, insert 150 provides vibration attenuation when the club head strikes a golf ball, resulting in favorable feel characteristics. These favorable characteristics are most evident when resilient materials are used for insert 150. Resilient materials further provide the user with a tactile sensation of softness when handling the club head, which inspires confidence and generally causes the user to associate the tactile softness with soft feel when striking a ball with the club.

Insert 150 may also be made of, for example, a low density resilient polymer having a specific gravity ranging from about 0.95 to about 1.7, and Shore hardness of about 25 A to about 95 A. Examples of such materials can be found among the many different types of Silicones, Thermo Plastic Elastomers (TPE)/Thermo Plastic Rubbers (TPR), Thermo Plastic Ester Elastomers (TPEE), Thermo Plastic Olefins (TPO), Thermo Plastic Vulcanates (TPV), Melt Processible Rubbers (MPR), Thermo Plastic Sterenics (TPS), Flexible PVCs (F-PVC), Ethelyne Vinyl Acetates (EVA), Ionomer Resins (IR), and Thermo Plastic Polyurethanes (TPU).

An exemplary material of the silicone type is GE Silicones' Tufel® II 94605 series silicone. An exemplary TPV material is RTP Company's 2800B series, which is available in a variety of Shore hardnesses within the exemplary range given above.

In one embodiment, the specific location and shape of the recess 140, as well as a prominent contour of rear surface 153 of insert 150 causes the resilient material to protrude from the rear surface of the head in such a way that the user's palm and/or fingers are most likely to come into contact with the insert when handling the club head. Therefore, the volume of the insert 150 may be generally larger than the volume of recess 140, whereby the contour of rear surface 153 of the insert does not follow the contour of rear surface 115 of the club head so that the insert protrudes from the rear surface of the head. The volume of recess 140 corresponds to the volume of head material that would need to be removed from club head 100 to form recess 140 if the contour of rear surface 115 were extended over recess 140.

In a further embodiment of the invention, insert 150 may include a captive member 155 with insignia thereon contained within or formed in a resilient member 154. Variations of this configuration are depicted in FIGS. 14-17. The captive member 155 may be visually exposed by means of an aperture or extrusion in the resilient member 154, or by forming the resilient member 154 from a material that is sufficiently translucent and which encases captive member 155. Although captive member 155 may be formed of any suitable material, if it is made from a more rigid material than that used for resilient member 154, more detail options may be realized, as well as greater ease of production and superior longevity of painted details. The captive member may also be provided in a color that is different from the resilient material to provide added contrast or visual effect, or to eliminate the need for painted or printed details. Various alternate insert configurations of this type appear in the figures.

In still another combination, the various club head geometries of the present invention, as described in this application, may be used in combination with a vibration Absorptive structure, instead of a resilient member as described herein. Such vibration absorptive structures are described in Hutin et al. U.S. Pat. No. 5,316,298, the entire disclosure of which is hereby incorporated by reference in the present application. Such vibration absorptive plaques or structures are typically adhered to a bottom surface of the rear cavity or recess in an iron type golf club head.

It is desirable to provide a plurality of bounce or bounce angle configurations for each loft in which the iron-type club heads according to various embodiments of the present invention are made. For example, high bounce may be achieved by club heads having a bounce angle in the range of about ten to about eighteen degrees, while low bounce may be achieved by a bounce angle in the range of about zero to about ten degrees. Each individual configuration varies the volume of head material in the sole region to create the desired bounce angle. To maintain proper swing weighting without significantly modifying the overall head shape for each bounce configuration, mass may be added or subtracted from bottom surface 141 or perimeter wall(s) 142 of the recess. Referring to FIGS. 7-10 and 19-22, an embodiment is shown wherein mass is added to or subtracted from the head in the vicinity of recess 140. In one embodiment the recess may be filled with an insert 150 such that no apparent difference exists in the outer shape of same-lofted heads, among various bounce configurations, apart from the variation in sole shape.

Figure 19:
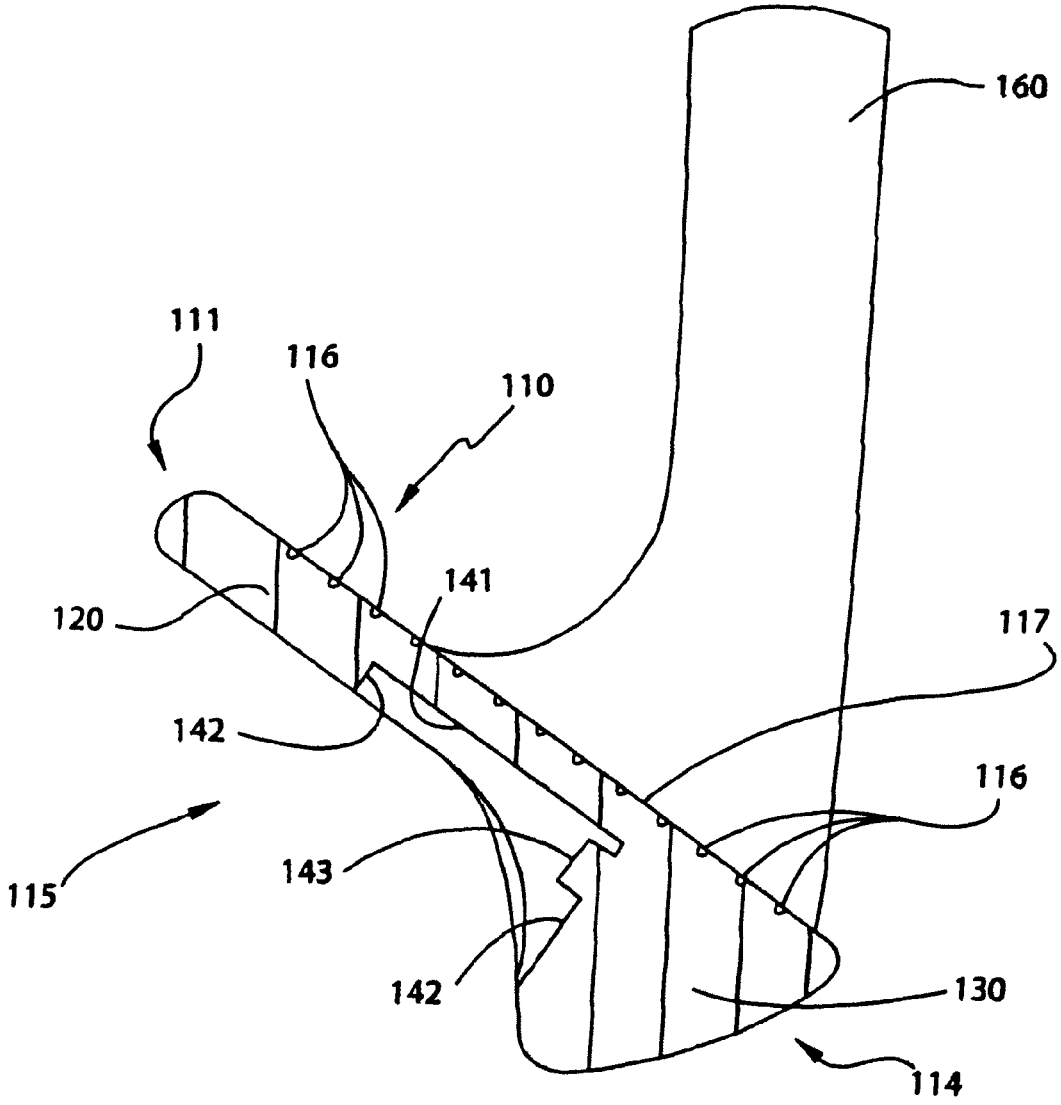
FIG. 19 is a cross-sectional view of another embodiment of the club head of FIG. 9, where the step-like configuration is located on cavity perimeter wall 142.
Figure 20:
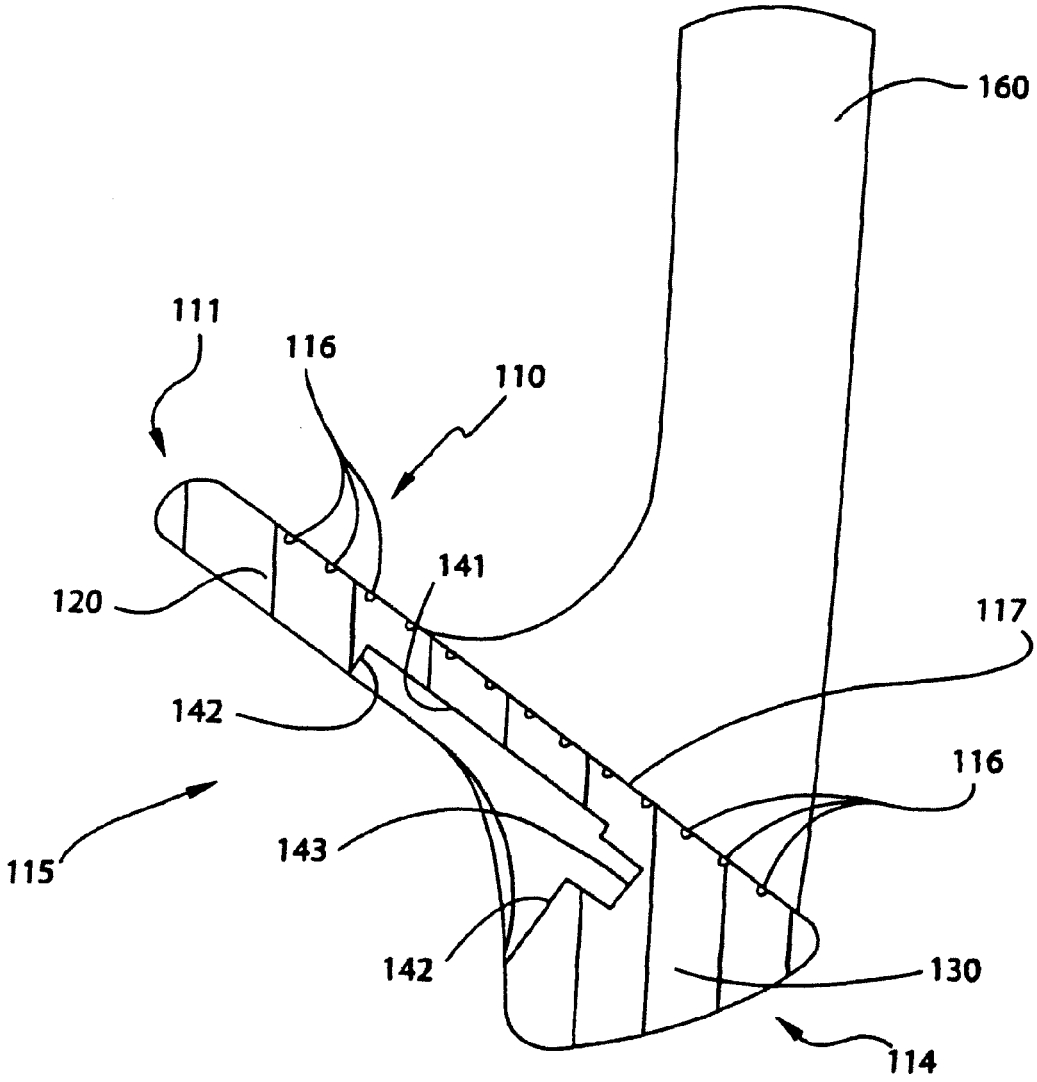
FIG. 20 is a cross-sectional view of another embodiment of the club head of FIG. 19.
Figure 21:
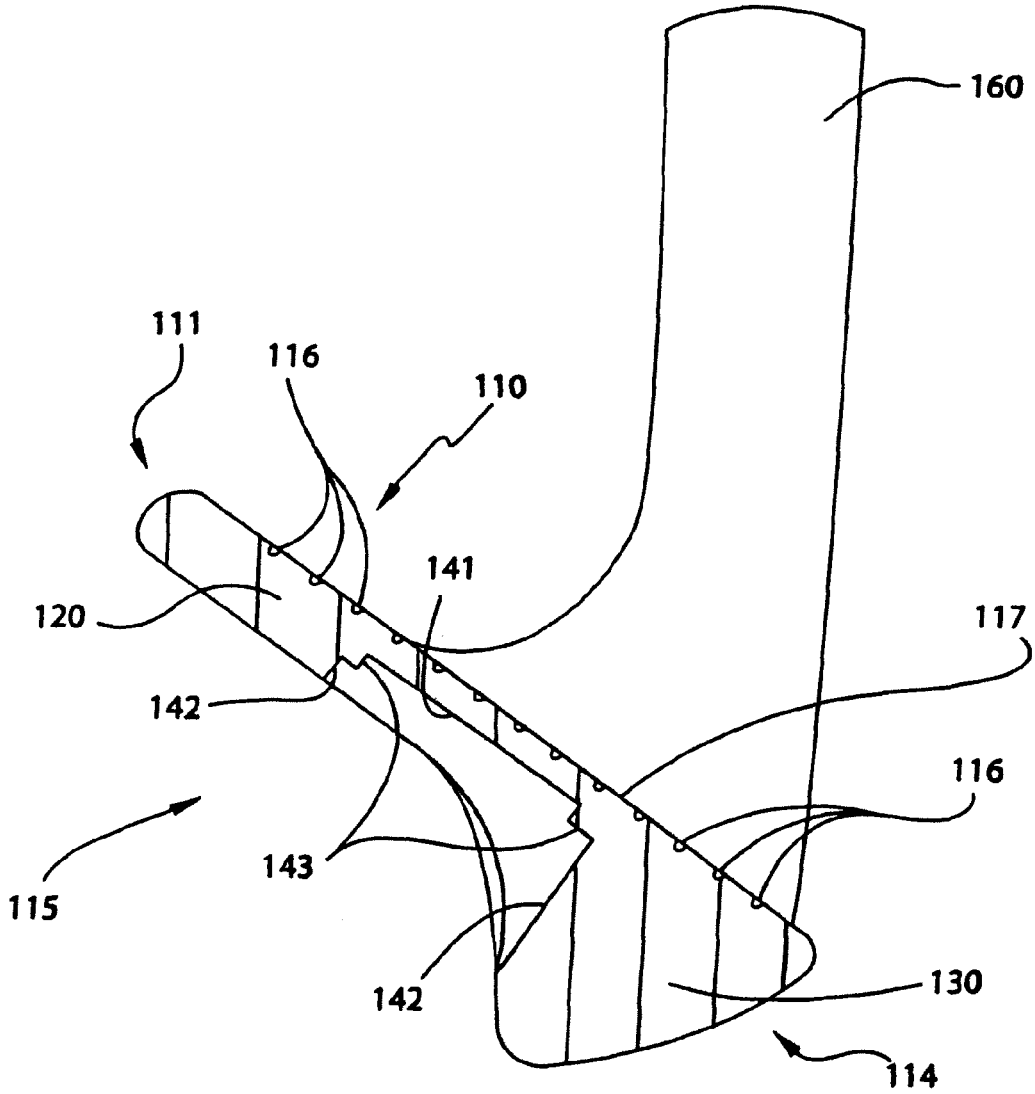
FIG. 21 is a cross-sectional view of yet another embodiment of the club head of FIG. 19, where the step is located on both cavity perimeter wall 142 and bottom surface 141.
Figure 22:
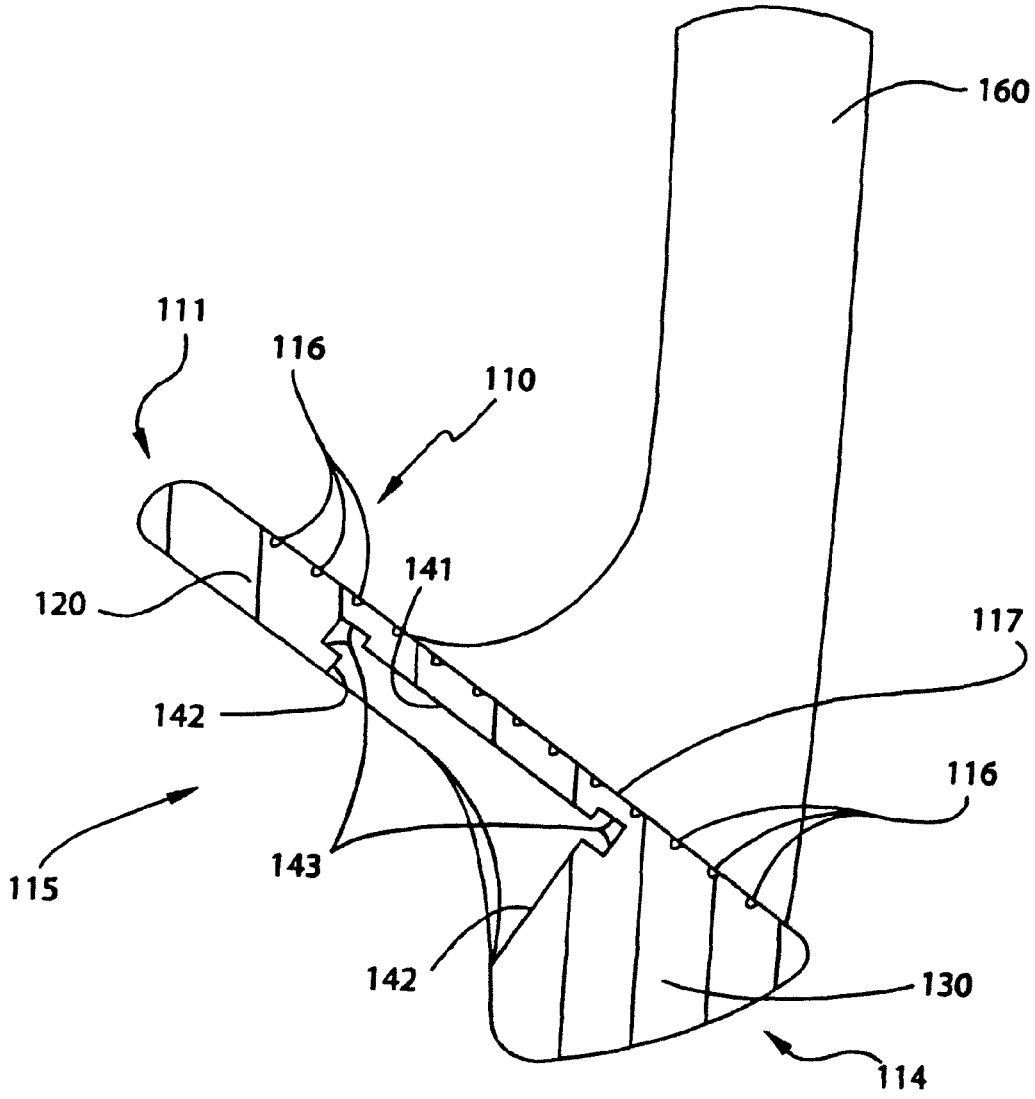
FIG. 22 is a cross-sectional view of another embodiment of the club head of FIG. 21.

Thus, a positive or negative step 143 is formed in recess 140 by adding or subtracting material from bottom surface 141 (as shown in FIGS. 7-10), or alternatively, perimeter wall 142 (as shown in FIGS. 19 and 20), or both perimeter wall 142 and bottom wall 141 (as shown in FIGS. 21 and 22). To maintain proper balance using the technique described above, the volume of step 143 decreases from a positive value for a high bounce sole configuration (as shown in FIGS. 7, 8, 19 and 21), to a negative value for a low bounce sole configuration (as shown in FIGS. 9, 10, 20 and 22). Step 143 can be provided having any other shape or configuration desired, and need not necessarily require that material be removed from the bottom surface 141. The step 143 can be provided with equal effect on either the recess perimeter wall(s), or on both the perimeter wall(s) and the bottom surface.

To reduce the number of required components, a single insert can be used for a variety of club head configurations by providing an indentation on either perimeter wall 152 or forward surface 153 to accommodate any additional material which may be added to any of the corresponding recess surfaces with which insert 150 mates.

The insert may be secured within recess 140 using any known techniques to secure inserts within a golf club head, including, but not limited to, adhesives, forming or curing or vulcanizing the insert within the recess, plastic deformation of the club head material surrounding the insert, press fitting, providing retention elements on the club head within recess 140 or on insert 150, or both.

The above-described embodiments of the club head are given only as examples. Therefore, the scope of the invention should be determined not solely by the disclosed illustrations, but by their equivalents and the appended claims.

What is claimed is:

1. A golf club head comprising:

a strike face;

a rear surface generally opposite the strike face, the rear surface including a first recess;

an insert in the recess, the insert comprising a first color and a second recess extending entirely through the insert; and a captive member at least partially within the second recess, the captive member comprising a second color different from the first color.

2. The golf club head of claim 1, wherein the captive member further comprises an anterior surface facing away from the striking face, the insert partially overlapping onto the anterior surface.

3. The golf club head of claim 1, wherein the insert further comprises a first material and the captive member further comprises a second material, the second material being more rigid than the first material.

4. The golf club head of claim 1, wherein the first recess further comprises a bottom surface, the captive member spaced from the bottom surface.

5. The golf club head of claim 1, wherein at least one of the insert and the captive member has a lower specific gravity than the rest of the golf club head.

6. The golf club head of claim 1, wherein the insert and the captive member are made from the same material.

7. The golf club head of claim 1, wherein:

the captive member further includes a captive member anterior surface, facing away from the striking face; and a contrast between the anterior surface of the captive member and the insert defines an insignia.

8. A golf club head comprising:

a main body including a striking face, and a rear surface opposite the striking face, a top portion, and a sole portion opposite the top portion;

a first recess extending into the main body;

an insert in the first recess, the insert including a second recess; and a captive member at least partially within the second recess, the captive member comprising a captive member anterior surface having a periphery that defines an insignia, wherein the insert comprises a transparent material and encases the captive member.

9. The golf club head of claim 8, wherein the insert further comprises a first material and the captive member further comprises a second material, the second material being more rigid than the first material.

10. The golf club head of claim 8, wherein the first recess further comprises a bottom surface and the captive member is spaced from the bottom surface.

11. The golf club head of claim 8, wherein at least one of the insert and the captive member has a lower specific gravity than the main body.

12. The golf club head of claim 8, wherein the insert and the captive member are made from the same material.

13. The golf club head of claim 8, wherein the first recess comprises a bottom surface and the captive member directly contacts the bottom surface.

14. The golf club head of claim 8, wherein the insert comprises a transparent material.

* * * * *